US007708367B2

(12) United States Patent
Onodera et al.

(10) Patent No.: US 7,708,367 B2
(45) Date of Patent: May 4, 2010

(54) PRINTING APPARATUS, PRINTING SYSTEM, AND PRINTING METHOD

(75) Inventors: Kazuo Onodera, Yokohama (JP); Takuma Washizuka, Noda (JP); Masato Yajima, Mitaka (JP)

(73) Assignee: Canon Finetech Inc., Joso-shi (JP)

( * ) Notice: Subject to any disclaimer, the term of this patent is extended or adjusted under 35 U.S.C. 154(b) by 445 days.

(21) Appl. No.: 11/832,857

(22) Filed: Aug. 2, 2007

(65) Prior Publication Data

US 2008/0036845 A1 Feb. 14, 2008

(30) Foreign Application Priority Data

Aug. 8, 2006 (JP) ..... 2006-215153
Jul. 10, 2007 (JP) ..... 2007-181372

(51) Int. Cl.
*B41J 2/205* (2006.01)
*B41J 29/38* (2006.01)

(52) U.S. Cl. ..... 347/15; 347/14

(58) Field of Classification Search ..... 347/12–15, 347/182, 40–42
See application file for complete search history.

(56) References Cited

U.S. PATENT DOCUMENTS

2007/0296747 A1* 12/2007 Inaba et al. ..... 347/12

FOREIGN PATENT DOCUMENTS

JP 2001246738 A * 9/2001

* cited by examiner

*Primary Examiner*—Stephen D Meier
*Assistant Examiner*—Rene Garcia, Jr.
(74) *Attorney, Agent, or Firm*—Fitzpatrick, Cella, Harper & Scinto

(57) ABSTRACT

The present invention provides a printing apparatus, a printing system, and a printing method which can excellently print various images while taking the advantages of driving of a print head in a time divisional manner. Dispersive driving control or sequential driving control is selected in accordance with the attributes of an image to be printed to drive a plurality of print element groups in the print head in a time divisional manner under the selected dispersive or sequential driving control. The dispersive driving control drives the plurality of print element groups in a time divisional manner so as to sequentially drive the print element groups not located close to each other. The sequential driving control drives the plurality of print element groups in a time divisional manner so as to sequentially drive the print element groups located close to each other.

11 Claims, 10 Drawing Sheets

PRINTING APPARATUS, PRINTING SYSTEM, AND PRINTING METHOD

BACKGROUND OF THE INVENTION

1. Field of the Invention

The present invention relates to a printing apparatus, a printing system, and a printing method in which images are printed by driving a plurality of print elements in a print head in a time divisional manner.

2. Description of the Related Art

Printing apparatuses based on an ink jet scheme (ink jet printing apparatuses; ink jet printers) have been prevailing widely which print images on a print medium such as a sheet by ejecting ink droplets from a plurality of ink ejection ports in a print head to the print medium. Known method for ejecting ink droplet from the ink ejection port uses electrothermal converter (heater) or piezo element. The electrothermal converter supplies thermal energy corresponding to a driving pulse to ink in a nozzle to form a bubble in the ink so that the resulting bubbling energy can be utilized to eject an ink droplet from the nozzle. An image is printed on the print medium by ejecting ink droplets from a large number of nozzles in accordance with print data.

Such an ink jet printing apparatus can print a high quality image at a high speed. Further, with the ink jet printing apparatus, the print head does not contact the print medium during image printing, allowing a high quality image to be stably printed regardless of the surface condition of the print medium.

One type of ink jet printing apparatus is what is called a full line type printing apparatus (line printer). This type of printing apparatus prints an image while consecutively transferring a print medium, enabling an increase in the speed at which an image is printed (image formation speed). Japanese Patent Laid-Open No. 2005-238556 describes a full line type printing apparatus using a plurality of print heads each having a large number of nozzles integrally formed thereon and forming ink ejection ports (multi nozzle heads). The print heads are arranged in parallel in a direction crossing the direction in which the print medium is transported and cooperate in ejecting ink to print an image.

Further, Japanese Patent Laid-Open No. 2001-246738 describes a configuration in which a large number of nozzles in a print head are divided into a plurality of blocks that are driven on the basis of different driving signals. The driving signals have the same waveform, provide different nozzle driving timings, and are each selected for use for one of the blocks. This allows the nozzles in each block to be driven in a time divisional manner, reducing the number of nozzles simultaneously driven. This in turn prevents a variation in ink ejection property caused by a variation in the driving load on the print head. More specifically, when one raster of image along the direction in which the nozzles are arranged is printed, varying the nozzle driving timing among the blocks enables a reduction in the drop of the driving voltage for the print head.

For the full line type ink jet printing apparatus, to avoid the interference between nozzles located close to each other, the nozzles in each block are desirably driven in a time divisional manner so as to sequentially drive the nozzles in the blocks not located close to each other. The interference between the nozzles located close to each other may be the adverse effect of a variation in ink pressure resulting from driving of one nozzle, on the ink in the other nozzle. Avoidance of the interference between the nozzles located close to each other makes it possible to stably print a high quality image.

On the other hand, if the nozzles are driven in a time divisional manner so as to sequentially drive the nozzles in the blocks not located close to each other, then within a print time required for one raster of image, the driving time may vary relatively significantly between the nozzles in the blocks located close to each other. Thus, when an image including a bar code or a ruled line is printed using the nozzles in the blocks located close to each other, the linearity of the bar code or ruled line may be impaired.

SUMMARY OF THE INVENTION

The present invention provides a printing apparatus, a printing system, and a printing method which can print high-quality various images while taking the advantages of driving of a print head in a time divisional manner.

In a first aspect of the present invention, there is provided a printing apparatus that prints an image on a print medium by using a print head having a plurality of print elements arranged in a direction crossing a direction in which the print medium is conveyed, to drive a plurality of print element groups into which the plurality of print elements are divided, in a time divisional manner, the apparatus comprising: dispersive driving means for driving the plurality of print element groups in a time divisional manner so as to sequentially drive the print element groups not located close to each other; and sequential driving means for driving the plurality of print element groups in a time divisional manner so as to sequentially drive the print element groups located close to each other, wherein the dispersive driving means or the sequential driving means is selected for functioning in accordance of attributes of the image to be printed.

In a second aspect of the present invention, there is provided a method for printing an image on a print medium by using a print head having a plurality of print elements arranged in a direction crossing a direction in which the print medium is conveyed, to drive a plurality of print element groups into which the plurality of print elements are divided, in a time divisional manner, the method comprising: a step of selecting dispersive driving control or sequential driving control in accordance with the image to be printed to drive the plurality of print element groups in a time divisional manner, and wherein the dispersive driving control drives the plurality of print element groups in a time divisional manner so as to sequentially drive the print element groups not located close to each other, and the sequential driving control drives the plurality of print element groups in a time divisional manner so as to sequentially drive the print element groups located close to each other.

The present invention selects the time divisional driving scheme for the print head in accordance with the attributes of the image to be printed. This enables high-quality various images to be printed while taking the advantages of the time divisional driving scheme. For example, to print an image giving priority to the linearity of a bar code or a ruled line, the dispersive driving control is selected. To print a normal image giving priority to total image quality, the sequential driving control is selected. This enables the respective high-quality images to be printed.

Further features of the present invention will become apparent from the following description of exemplary embodiments (with reference to the attached drawings).

DESCRIPTION OF THE EMBODIMENTS

Embodiments of the present invention will be described below with reference to the drawings.

Figure 1:
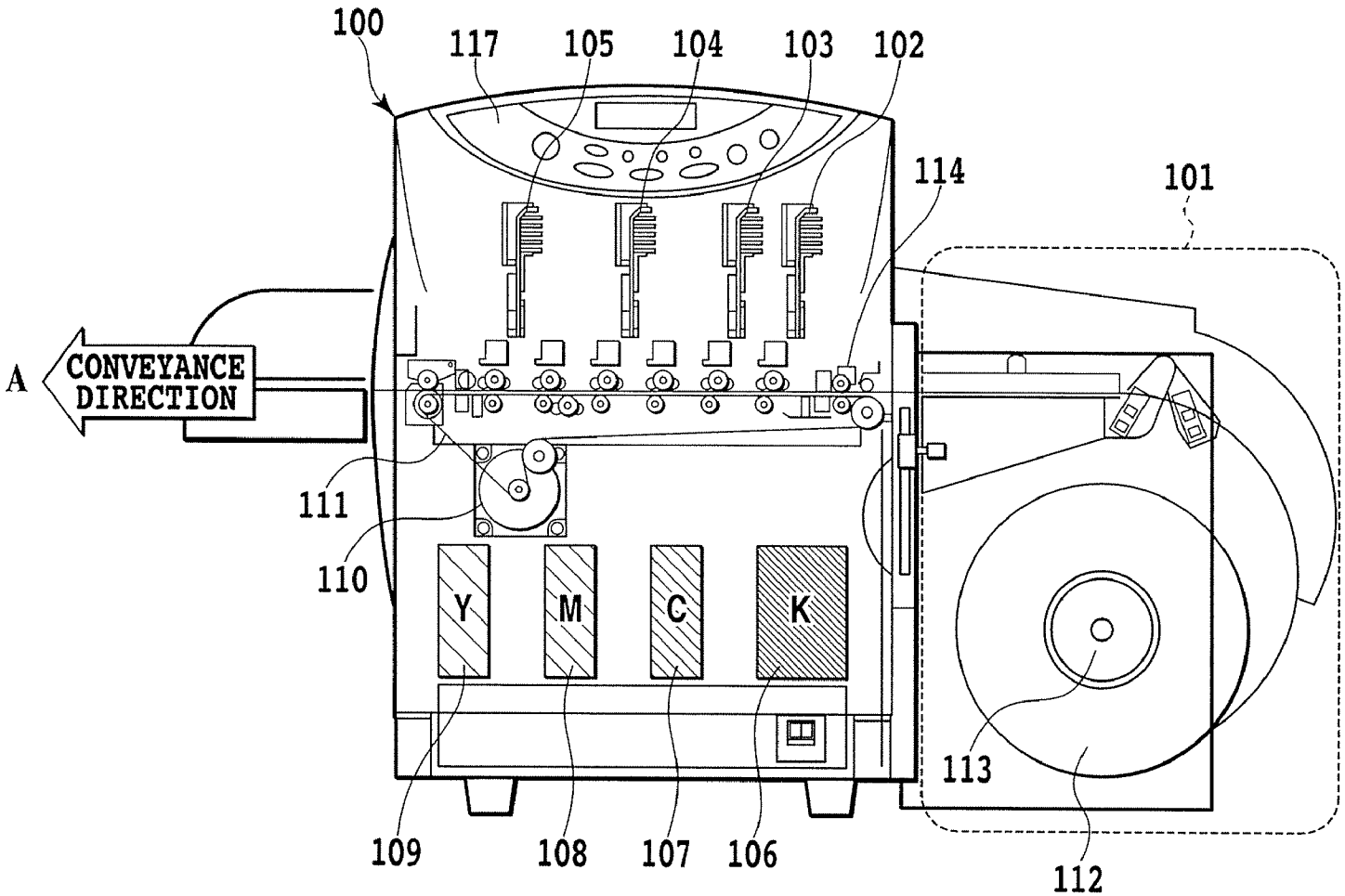
FIG. 1 is a front view of an example of a printing apparatus to which the present invention is applicable.

FIG. 1 is a schematic diagram of a printing apparatus to which the present invention is applicable.

A printing apparatus 100 in the present example is of a type called a label printer. The printing apparatus 100 prints labels (print media) temporarily releasably attached to an elongate label paper 112. The printing apparatus 100 comprises print heads 102, 103, 104, 105 that apply black (K), cyan (C), magenta (M), and yellow (Y) inks to the labels. The print heads are arranged in parallel along the direction in which the label paper 112 is conveyed (in the direction of arrow A). Each of the print heads comprises a plurality of print elements arranged in a line along a direction crossing the conveying direction of the label paper 112. The line of print elements is formed to be long enough to cover the entire label in its width direction.

The print heads 102 to 105 in the present example are ink jet print heads that can eject ink and each comprise, as print elements, a plurality of nozzles that can eject ink from ejection ports. The plurality of nozzles form a nozzle line (a line of print elements) along the direction crossing the conveying direction of the label paper 112 (in the present example, the direction orthogonal to the conveying direction). Accordingly, the print heads in the present example are what is called line heads that are elongate and operate on the ink jet scheme. Each of the print heads entirely covers the label as a print medium in its width direction. Each of the nozzles comprises an ejection energy generation means for generating ejection energy required to eject ink from the ejection port. The ejection energy generation means may be, for example, an electrothermal converter (heater) or a piezo element. The electrothermal converter generates heat to bubble the ink so that the resulting bubbling energy can be utilized to eject ink droplet from the nozzle.

The print heads 102 to 105 eject the black (K), cyan (C), magenta (M), and yellow (Y) inks, respectively, from the nozzles to enable color images to be printed on labels. The inks K, C, M, Y are supplied from ink cartridges 106, 107, 108, 109, respectively, to the corresponding print heads 102 to 105 through pumps and tubes (not shown).

A roll unit 101 is composed of a roll driving shaft 113 around which the rolled label paper 112 is installed, a motor (not shown) that drives the roll driving shaft 113, and the like. Reference numeral 117 denotes an operation panel for the printing apparatus comprising a power supply ON/OFF switch, a printing apparatus ON-LINE/OFF-LINE switch, and a printing apparatus status display LCD.

Figure 2A:
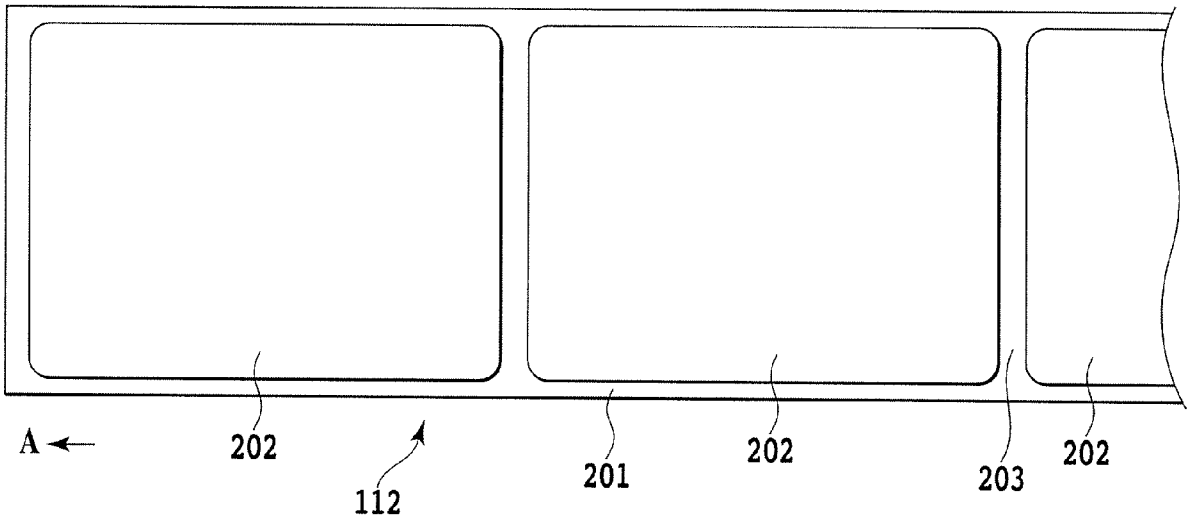
FIG. 2A is a plan view of an example of label paper used for the printing apparatus in FIG. 1.
Figure 2B:
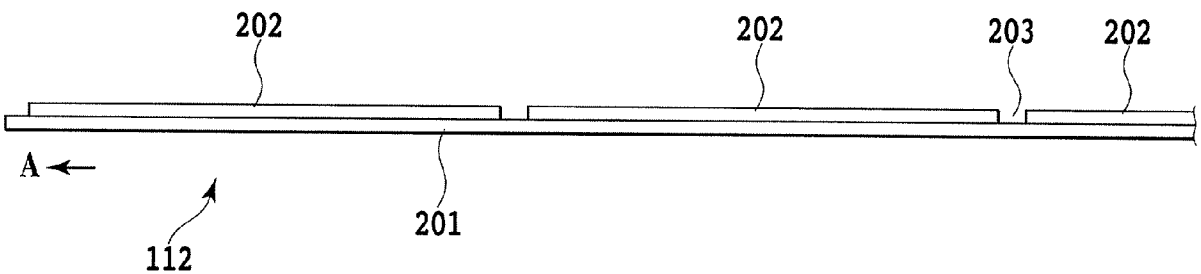
FIG. 2B is a side view of the label paper.

As shown in FIGS. 2A and 2B, the label paper 112 has a plurality of labels 202 temporarily releasably attached to a translucent, elongate separator 201. During a printing operation, the label paper 112 is conveyed in the direction of arrow A at a generally constant speed. The labels 202 are sensed by a transmissive sensor 114 provided upstream of the print head 102 in the conveying direction of the label paper 112. The transmissive sensor 114 comprises a light emission section located below a conveyance path for the label paper 112 and a light reception section located above the conveyance path. When the label paper 112 passes between the light emission section and the light reception section, the transmissive sensor can sense the leading end and trailing end of the label 202 in the conveying direction shown by arrow A on the basis of the difference in transmission light quantity between a portion on which the label 202 is temporarily attached and a gap portion 203 which is positioned between the adjacent labels 202.

The separator 201 is ideally more transparent. Any of various materials is used as the separator 201 in terms of the reliability with which the labels 202 are temporarily attached, the operability of releasing the labels 202 from the separator 201, and the like. A wide variety of translucent materials of varying transparency are now used as the separator 201.

The increased quantity of light from a light source provided in the light emission section of the transmissive sensor 114 improves the operational reliability of the reception section with respect to external light (noise) even with the reduced sensitivity of the light reception section. As such a light source, an infrared LED with a condenser lens can be used.

Figure 3:
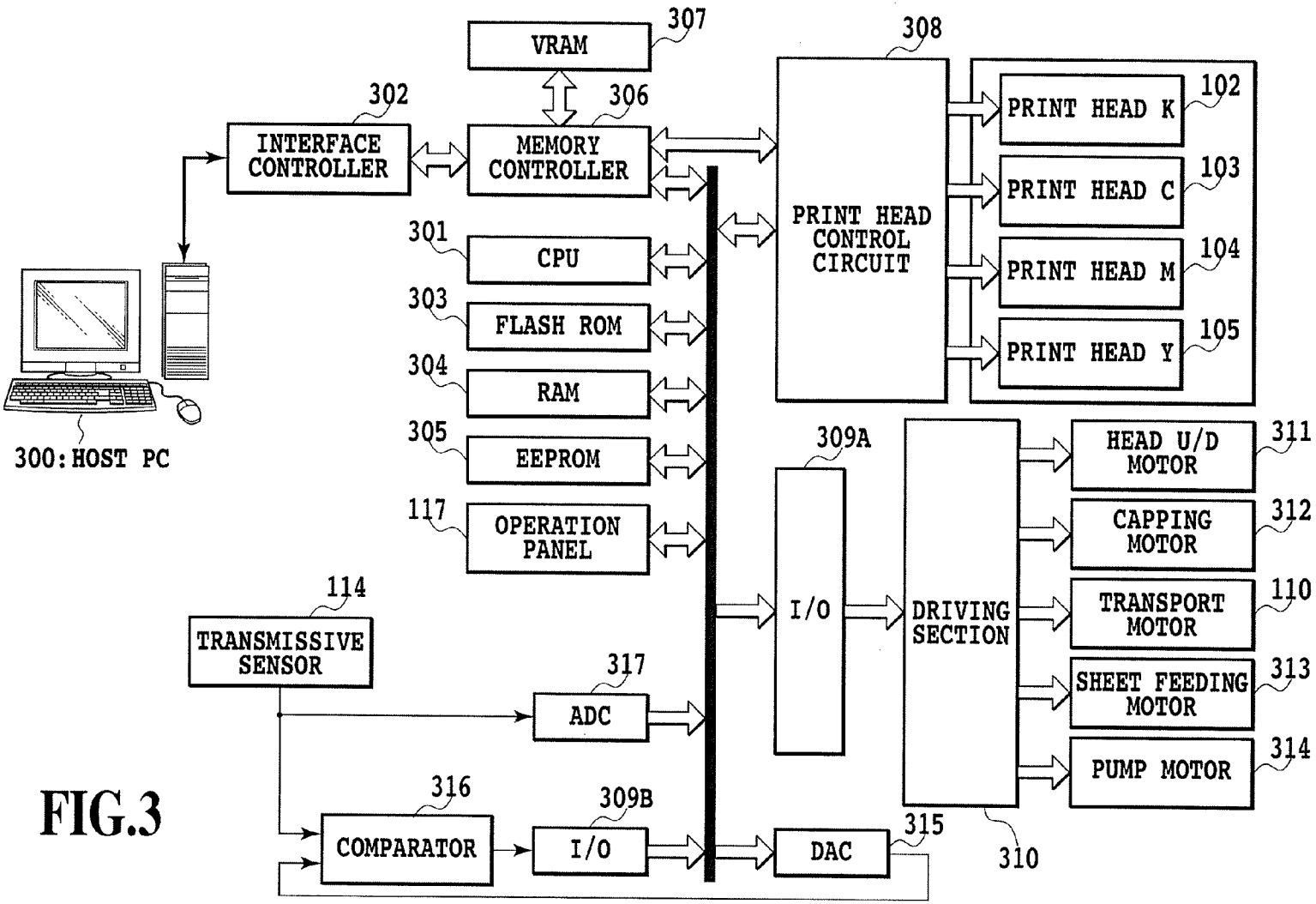
FIG. 3 is a block diagram of a control system for the printing apparatus in FIG. 1.

FIG. 3 is a block diagram of a control system for the printing apparatus 100.

A host PC (host apparatus; information processing apparatus) 300 transfers print data to be printed on the label 202 to an interface controller 302 in the printing apparatus 100. The host PC 300 then instructs the printing apparatus 100 to start a printing process. The host PC 300 can also transfer commands specifying the number of print media (in the present example, labels) and the type, size, and the like of the print media to the interface controller 302. A CPU (Central Processing Unit) 301 is an arithmetic processing apparatus that generally controls the printing apparatus 100 in connection with reception of print data, a printing operation, handling of print media, and the like.

CPU 301 analyzes a received command and then instructs a memory controller 306 to perform a drawing operation. This allows image data on the color components of the print data to be decompressed into a bit map on a VRAM 307. The CPU 310 uses a head U/D motor 311 that drives the print heads up and down, to move the print heads 102 to 105 to a print position. At this time, the CPU 310 drivingly controls a capping motor 312 that moves a cap mechanism (not shown) rightward and leftward in FIG. 1 along the conveying direction of the label paper 112. Moreover, to feed the label paper 112, the CPU 301 allows a sheet feeding motor 313 to operate a driving shaft 113 in a sheet feeding section 101 to start feeding the label paper 112. The CPU 301 subsequently allows a conveyance motor 110 to drive a conveyance belt 111 to convey the label paper 112 to a print position located opposite the print heads.

A pump motor 314 is used for the supply of ink, an operation of cleaning the print heads 102 to 105, pressurization of ink, and the like. However, the pump motor 314 is not related directly to the present invention and will not be described below. The motors 110, 311 to 314 are driven by a motor driving section 310 connected to a bus via an I/O port 309A.

To determine a print timing for the label paper 112 conveyed at a constant speed in the direction of arrow A, the CPU 301 allows the transmissive sensor 114 to detect the leading end of the label 202. The CPU 301 can read an output level (analog value) from the transmissive sensor 114 via an AD converter 317 almost in real time.

An output from the transmissive sensor 114 is also supplied to one input section of a comparator 316. A reference level (threshold voltage) that can be changed by the CPU 301 is supplied to the other input section of the comparator 316 via a DA converter 315. The CPU 301 can read an output from the comparator 316 via an input port 309B almost in real time.

A memory controller 306 sequentially reads image data on each color from the VRAM 307 in synchronism with the conveyance of the label paper 112. The memory controller 306 then transfers the image data on each color to the corresponding print head 102 to 105 via a print head control circuit 308. The print heads 102 to 105 then eject ink on the basis of the corresponding image data, enabling a color image to be printed on the label 202.

Those of the above operations of the printing apparatus 100 which are performed by the CPU 301 are performed on the basis of process programs stored in a program ROM 303. A work RAM 304 is used as a work memory. An EEPROM 305 is a nonvolatile memory that stores set values inherent in the printing apparatus such as fine-tuning values for the relative print positions of the print heads.

Now, a scheme of driving the print heads 102 to 105 will be described.

Figure 4:
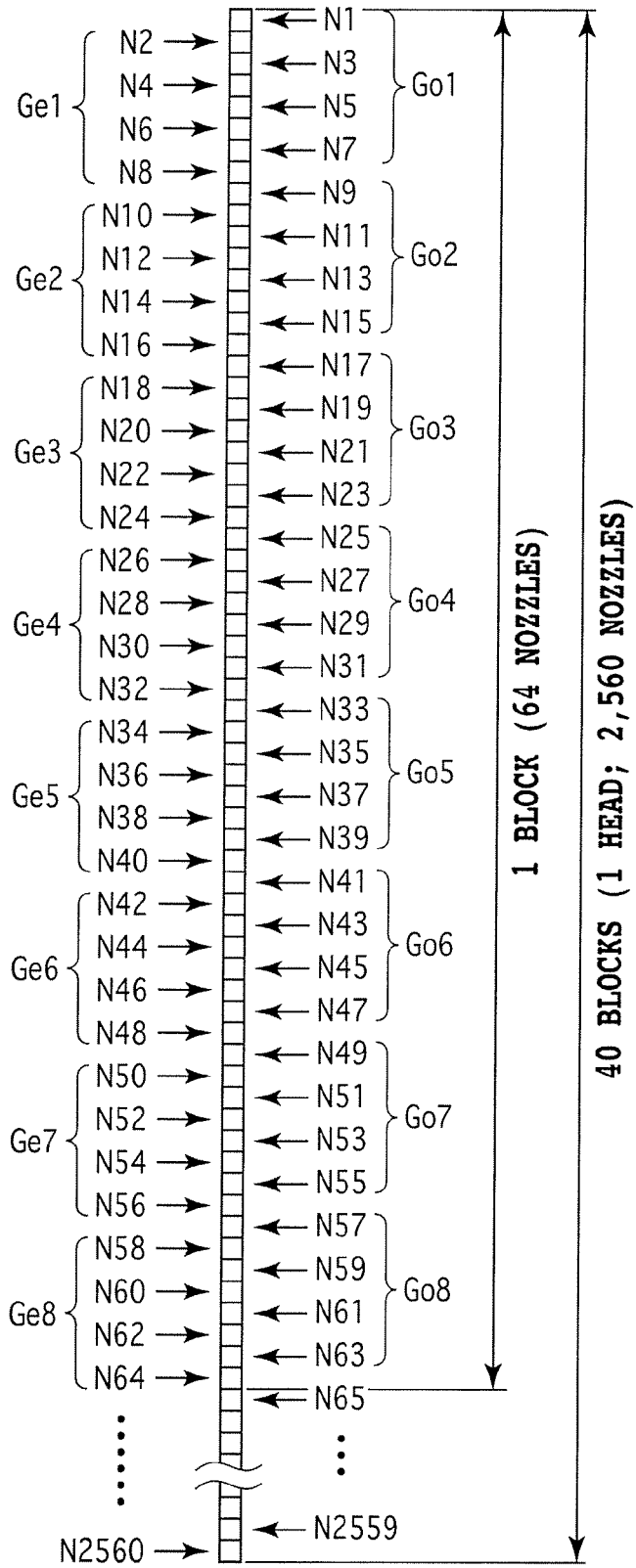
FIG. 4 is a diagram illustrating the relationship between nozzle numbers and nozzle groups in a print head used in the printing apparatus in FIG. 1.

As shown in FIG. 4, the number of nozzles in the print head in the present example is 2,560; the nozzle number ranges from N1 to N2,560. The nozzles are divided into 40 blocks each including 64 nozzles for driving control. Nozzles with odd nozzle numbers (N1, N3, N5, . . . , N2,559) are hereinafter referred to as "odd-numbered nozzles". Nozzles with even nozzle numbers (N2, N4, N6, . . . , N2,560) are hereinafter referred to as "even-numbered nozzles". The 64 nozzles in one block are divided into groups each including eight nozzles. The eight nozzles are divided into an odd-numbered nozzle group Go including four odd-numbered nozzles and an even-numbered nozzle group Ge including four even-numbered nozzles. The 64 nozzles (N1 to N64) in one block are divided into 18 groups including eight odd-numbered nozzle groups Go1 to Go8 and eight even-numbered nozzle groups Ge1 to Ge8. Similarly, the 64 nozzles in each of the other blocks are also divided into 18 nozzle groups. As described below, for the nozzles in each block, the individual nozzle groups can be driven using independent timings. This enables a reduction in the number of nozzles simultaneously driven and thus in the peak current value in the print heads.

The driving control of the print heads includes dispersive driving control and sequential driving control. The dispersive driving control involves driving the nozzle groups in a time divisional manner so that nozzle groups (print element groups) not located close to each other are sequentially driven. In the dispersive driving control, since the earlier driven nozzle group is physically separate from the next driven nozzle group, an ink-ejection function is stabilized. The sequential driving control involves driving the nozzle groups in a time divisional manner so that nozzle groups that are located close to each other are sequentially driven.

In the present embodiment, those of the odd-numbered nozzle groups Go1 to Go8 which are adjacent to each other are in the relationship of nozzle groups located close to each other. Those of the even-numbered nozzle groups Ge1 to Ge8 which are adjacent to each other are also in the relationship of nozzle groups located close to each other. Moreover, pairs of the nozzle groups Go1 and Ge1, Go2 and Ge2, Go3 and Ge3, and Go4 and Ge4 are each in the relationship of nozzle groups located close to each other. Similarly, the pairs of the nozzle groups Go5 and Ge5, Go6 and Ge6, Go7 and Ge7, and Go8 and Ge8 are each in the relationship of nozzle groups located close to each other. That is, a pair of adjacent odd-numbered nozzle groups, a pair of adjacent even-numbered nozzle groups, and a pair of an odd-numbered nozzle group and an even-numbered nozzle group which include adjacent nozzles are in the relationship of nozzle groups located close to each other. Nozzle groups not located close to each other are not in the relationship of nozzle groups located close to each other.

The dispersive driving control and the sequential driving control will be described below.

(First Example of the Dispersive Driving Control)

Figure 5:
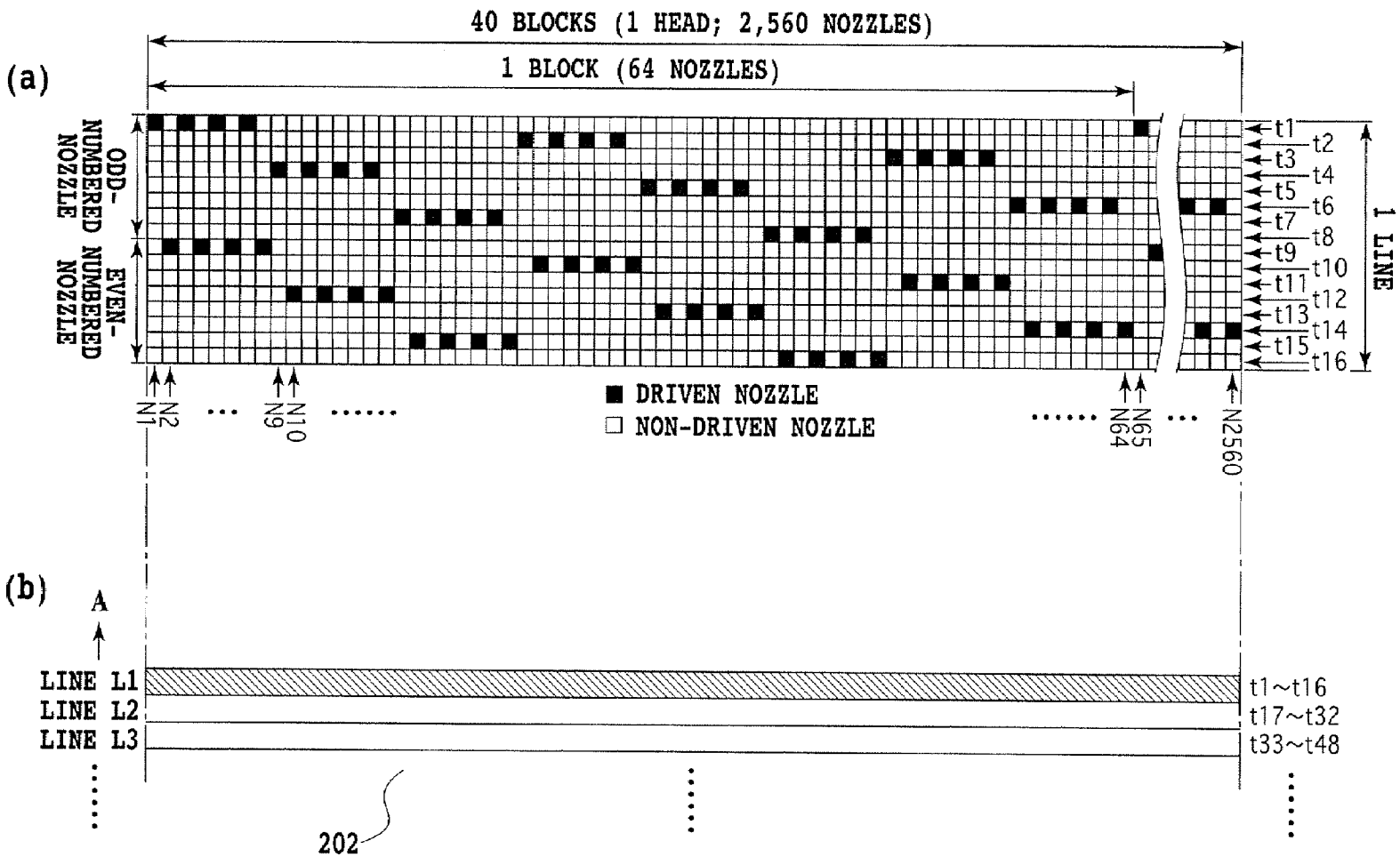
FIG. 5 is a diagram illustrating the order in which the nozzles are driven in a first example of dispersive driving control.

FIG. 5 is a diagram illustrating a first example of the dispersive driving control. In (a) of FIG. 5, driving timings for the nozzle groups (Go1 to Go8, Ge1 to Ge8) are shown. In (b) of FIG. 5, an image in raster (line) units printed on the label 202 by ejecting ink from the nozzles are shown. To print one raster of image, the nozzle groups are dividedly driven at times t1, t2, t3, . . . , t16. That is, as shown in (a) of FIG. 5, the first line L1 on the label 202 is printed by divided printing at the times t1, t2, t3, . . . , t16. The next line L2 is printed by similar divided printing at times t17, t18, t19, . . . , t32. The next line L3 and succeeding lines are printed by similar divided driving.

The dispersive driving control in the present example dividedly controls the nozzle groups so that the earlier driven nozzle group is physically separate from the next driven nozzle group. That is, the consecutively driven nozzle groups are not located close to each other. This divided driving makes it possible to avoid the adverse effect of a variation in the pressure of the ink in one of the nozzles located close to each other which is driven earlier, on the other nozzle.

That is, at the first-half times t1 to t8, the odd-numbered nozzle groups Go1 to Go8 are driven in order of Go1, Go4, Go7, Go2, Go5, Go8, Go3, and Go6. At the second-half times t9 to t16, the even-numbered nozzle groups Ge1 to Ge8 are driven in order of Ge1, Ge4, Ge7, Ge2, Ge5, Ge8, Ge3, and Ge6. This divided driving of the nozzle groups is equally performed on the 40 blocks in parallel.

(First Example of the Sequential Driving Control)

In the dispersive driving control, the earlier driven nozzle group and the next driven nozzle group are not located close to each other. On the other hand, the sequential driving control sequentially drives the nozzle groups located close to each other.

Figure 6:
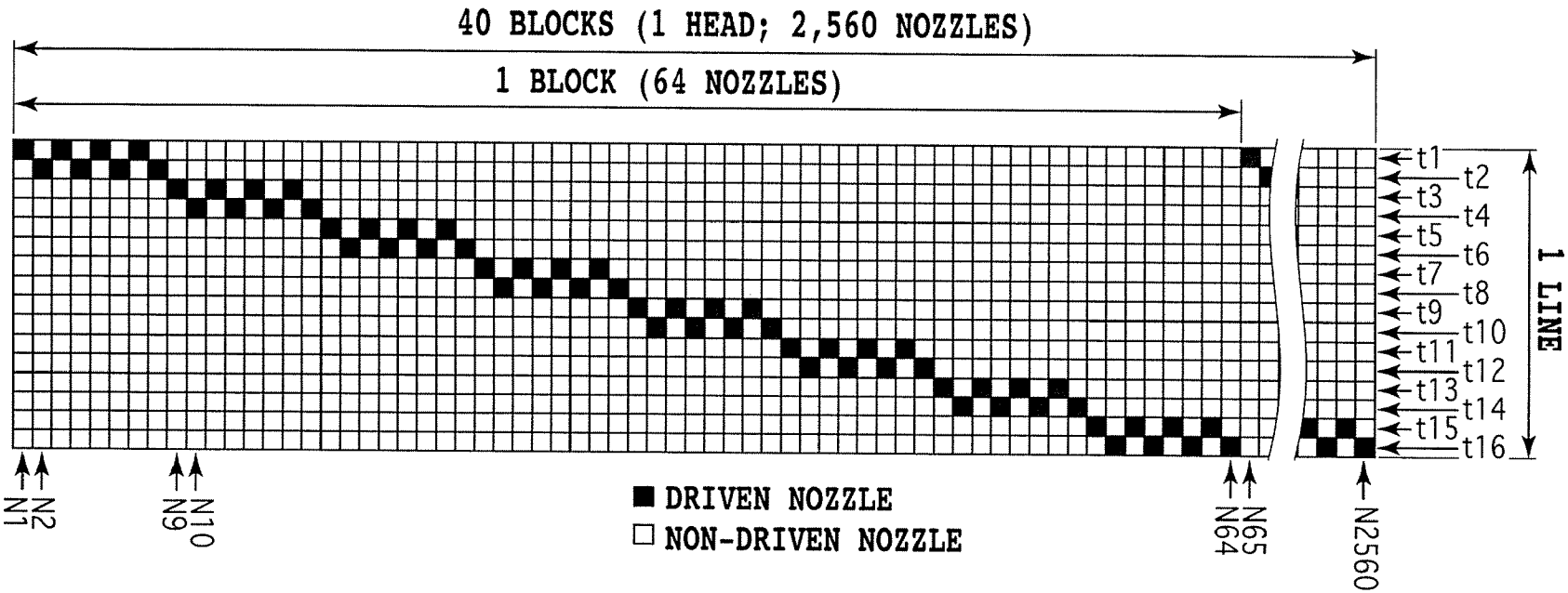
FIG. 6 is a diagram illustrating the order in which the nozzles are driven in a first example of sequential driving control.

As shown in FIG. 6, the sequential driving control in the present example alternately drives the odd and even-numbered nozzle groups at the times t1 to t16. That is, at the times t1, t3, t5, t7, t9, t11, t13, and t15, the odd-numbered nozzle groups Go1, Go2, Go3, Go4, Go5, Go6, Go7, and Go8 are sequentially driven. At the times t2, t4, t6, t8, t10, t12, t14, and t16, the even-numbered nozzle groups Ge1, Ge2, Ge3, Ge4, Ge5, Ge6, Ge7, and Ge8 are sequentially driven. The divided driving of the nozzle groups is equally performed on the 40 blocks in parallel.

(Second Example of the Sequential Driving Control)

Figure 7:
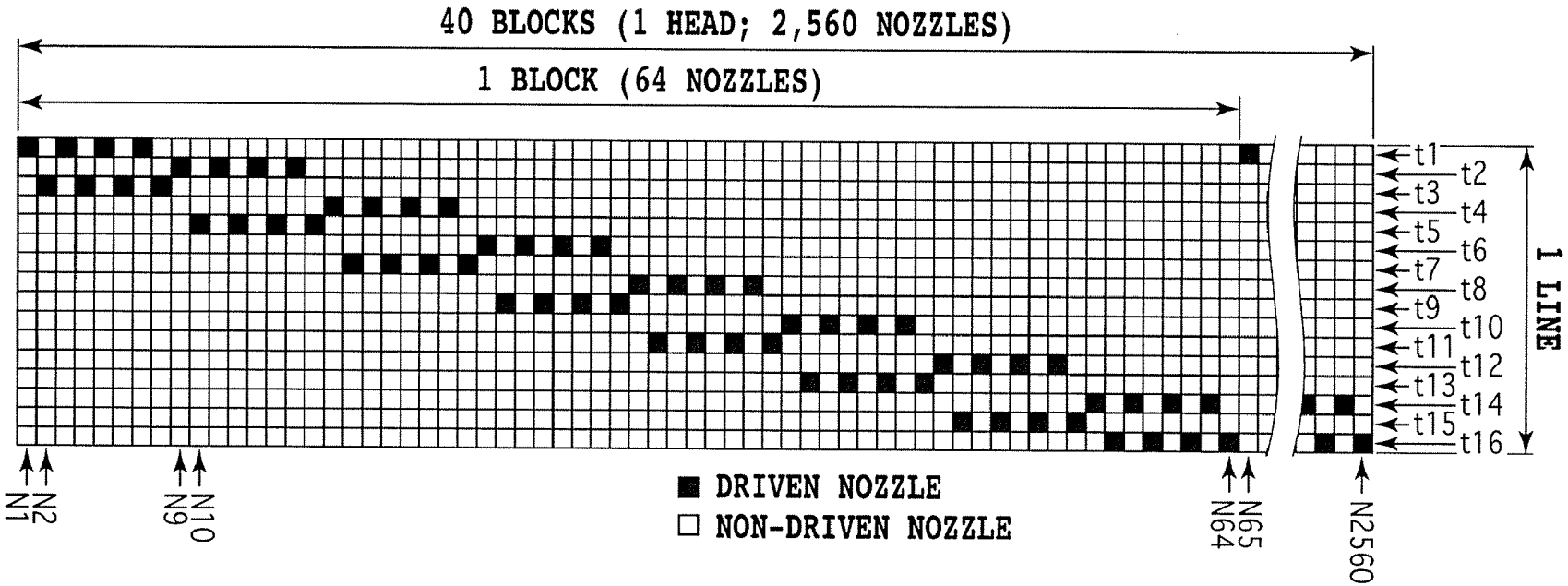
FIG. 7 is a diagram illustrating the order in which the nozzles are driven in a second example of the sequential driving control.

FIG. 7 is a diagram illustrating a second example of the sequential driving control. According to the sequential driving control in the present example, at the times t1, t2, t4, t6, t8, t10, t12, and t14, the odd-numbered nozzle groups Go1, Go2, Go3, Go4, Go5, Go6, Go7, and Go8 are sequentially driven. At the times t3, t5, t7, t9, t11, t13, t15, and t16, the even-numbered nozzle groups Ge1, Ge2, Ge3, Ge4, Ge5, Ge6, Ge7, and Ge8 are sequentially driven. This divided driving of the nozzle groups is equally performed on the 40 blocks in parallel.

(Third Example of the Sequential Driving Control)

Figure 8:
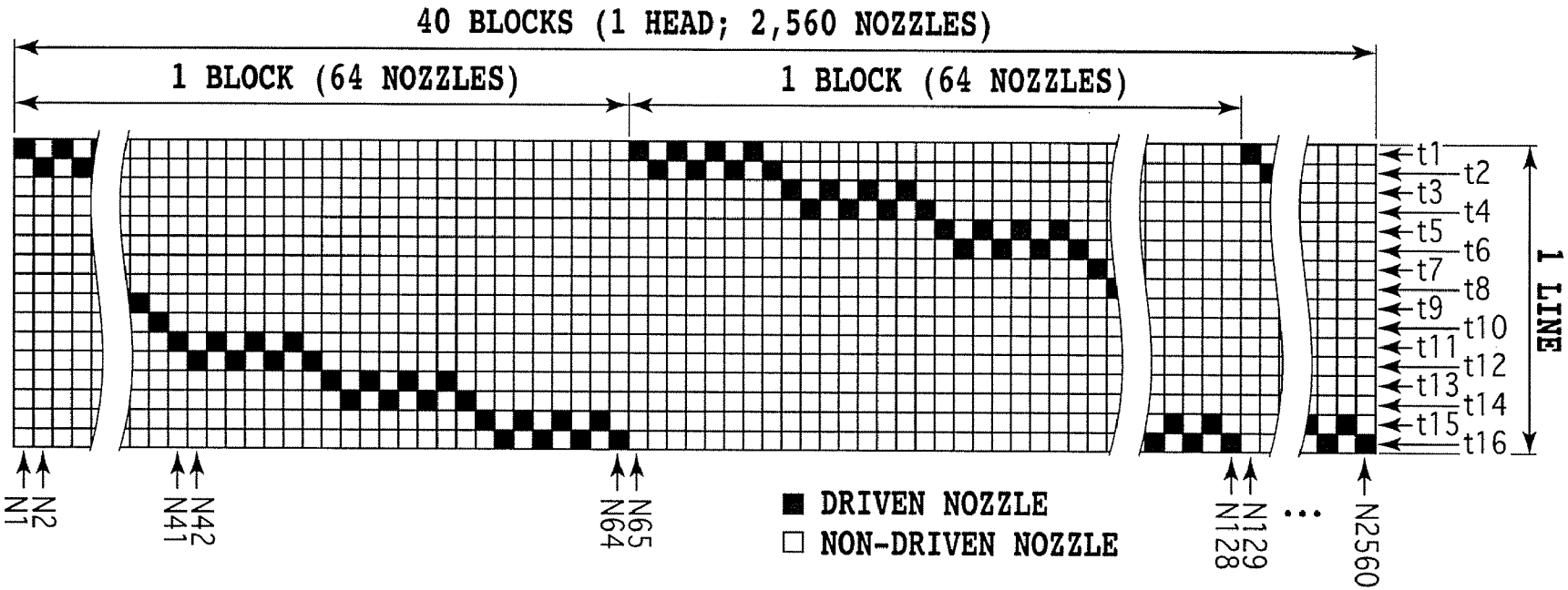
FIG. 8 is a diagram illustrating the order in which the nozzles positioned at the boundary between adjacent nozzle blocks are driven in accordance with the first example of the sequential driving control.

In the first example of the sequential driving control, the driving timing for the nozzle groups varies relatively significantly between the nozzle groups located at the boundary between the adjacent nozzle blocks. FIG. 8 shows the driving timing for the nozzle groups located at the boundary between the first block (nozzles N1 to N64) and the second block (nozzles N65 to N128). The nozzle groups Go8 and Ge8, located at an end of the first block and at the boundary between the first and second blocks, are driven at later times t15 and t16. On the other hand, the nozzle groups Go1 and Ge1, located at an end of the second block and at the boundary between the first and second blocks, are driven at earlier times t1 and t2. When the driving timing for the nozzle groups thus varies relatively significantly between the nozzle groups located at the boundary between the adjacent nozzle blocks, a step may be created in a part of the print image which corresponds to the boundary between the blocks.

Figure 9:
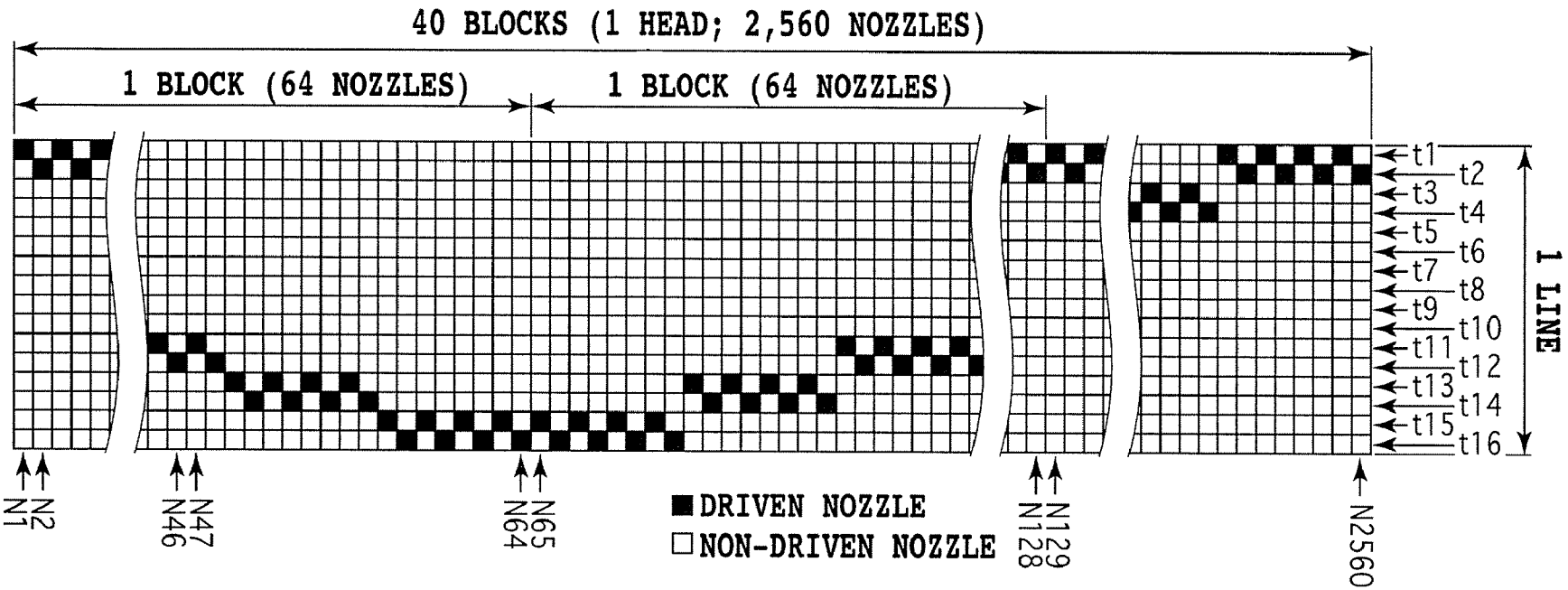
FIG. 9 is a diagram illustrating the order in which the nozzles positioned at the boundary between adjacent nozzle blocks are driven in accordance with a third example of the sequential driving control.

Thus, as shown in FIG. 9, the sequential driving control in the present example varies the control form among the blocks. That is, the nozzle groups in the first block are driven in an order similar to that in the first example of the sequential driving control. The nozzle groups in the second block are driven in an order opposite to that in the first example of the sequential driving control. Thus, the driving order of the nozzle groups is reversed between the adjacent blocks. That is, in the odd-numbered blocks, nozzle groups including nozzles with smaller nozzle numbers are driven earlier as in the case of the first example of the sequential driving control. In the even-numbered blocks, nozzle groups including nozzles with greater nozzle numbers are driven earlier in contrast to the first example of the sequential driving control.

According to this sequential driving control, as shown in FIG. 9, the driving timings for the nozzle groups Go1 and Ge1 in the second block correspond to the times t15 and t16 as is the case with the nozzle groups Go8 and Ge8, located at the end of the first block. Also for the other adjacent blocks, the difference in driving timing between the adjacent nozzles is reduced. Thus, even if adjacent nozzles belong to different blocks, the difference in driving timing between the nozzles is reduced, enabling an undisturbed high-quality image to be printed.

(Other Examples of the Dispersive Driving Control and the Sequential Driving Control)

The orders in which the nozzle groups are driven in the dispersive driving control and the sequential driving control are not limited to the above examples. The point is that the earlier driven nozzle group can be located away from the next driven nozzle group regardless of whether or not the nozzle groups are divided into the odd-numbered groups and the even-numbered groups. For example, the driving order of the nozzle groups may be reversed so that the times t1 to t16 in (a) of FIG. 5 are reversed to the times t16 to t1. On the other hand, for the sequential driving control, the point is that at least those of the nozzle groups in one block which are located close to each other can be sequentially driven regardless of whether or not the nozzle groups are divided into the odd-numbered groups and the even-numbered groups. For example, the driving order of the nozzle groups may be reversed so that the times t1 to t16 in FIGS. 6, 7, and 9 may be reversed to the times t16 to t1.

(Selection Between the Dispersive Driving Control and the Sequential Driving Control)

For printing of images such as characters, a totally well-coordinated image is more desirable than the accuracy of impacting positions of ink on a print medium, that is, the accuracy of positions of dots formed by ink. Accordingly, the above dispersive driving control is suitable for printing images such as characters for which total balance is desired. On the other hand, for printing of images such as bar codes, the linearity of the image and the accuracy of the thickness of a line are desired. Accordingly, the above sequential driving control is suitable for printing images such as bar codes.

The present invention selects one of the dispersive driving control and the sequential driving control as driving control for the print heads.

Figure 10:
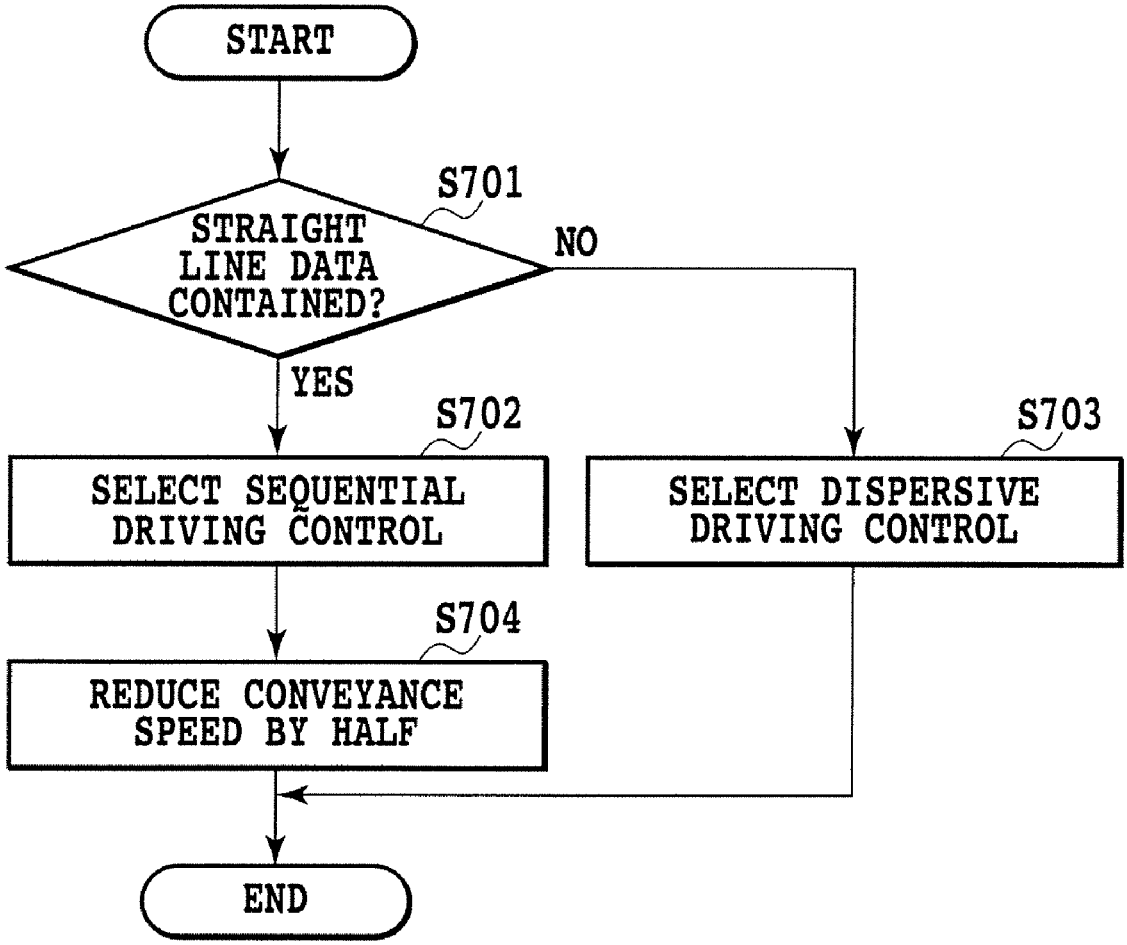
FIG. 10 is a flowchart illustrating a procedure of selecting the dispersive driving control or the sequential driving control.

FIG. 10 is a flowchart illustrating a procedure of selecting the driving control for the print heads.

First, the process determines whether or not data on an image to be printed includes straight line data indicating a bar code or the like (step S701). If the data includes such straight line data, the process proceeds to step S702 to select the sequential driving control. When the sequential driving control is thus selected, the speed at which the label paper 112 is conveyed is set half of that set for the selection of the dispersive driving control. For example, when the conveyance speed set for the selection of the dispersive driving control is 200 [mm/sec], the conveyance speed for the sequential driving control is set at 100 [mm/sec]. In order to avoid the interference between nozzles located close to each other, it is effective to set a lower conveyance speed for the sequential driving control, which sequentially drives nozzle groups located close to each other, than for the dispersive driving control.

If the process determines in step S701 that the data includes no straight line data, the process proceeds to step S703 to select the dispersive driving control.

The dispersive driving control function, the sequential driving control function, and the function of selecting one of the controls may all be provided in the printing apparatus or at least partly provide in the host PC 300. For example, the functions may be at least partly provided in application software in the host PC 300 which generates print data or driver software that receives the print data from the application software and that sends the data to the printing apparatus. Alternatively, the driving control may be selected by the printing apparatus having received the print data, on the basis of the received data.

Other Embodiments

The present invention is widely applicable to what is called full line type printing apparatuses, that is, various printing apparatuses using print heads each having a plurality of print elements arranged in a direction crossing the conveyance direction of a print medium. Accordingly, the print head has only to comprise a plurality of print elements that can form images and to be able to drive a plurality of print element groups into which the print elements are divided, in a time divisional manner. The print head is not limited to ink jet print heads comprising nozzles from which ink can be ejected, as print elements.

The dispersive driving control has only to be able to drive a plurality of print element groups in a time divisional manner so as to sequentially drive print element groups not located close to each other. The control form of the dispersive driving control is not limited to the above embodiments. Further, the sequential driving control has only to drive a plurality of print element groups in a time divisional manner so as to sequentially drive print element groups located close to each other. The control form of the sequential driving control is not limited to the above embodiments.

In the above embodiments, the plurality of blocks (print elements) are divided into 40 blocks each including nozzle groups (print element groups). In each of the blocks, a plurality of nozzle groups are controlled in a time divisional manner. However, the present invention may comprise any number of blocks and each block may include any number of nozzle groups.

For the dispersive driving control and the sequential driving control, it is only necessary to be able to selectively perform either control in accordance with the attributes of the image to be printed. The function of selecting either control may be provided in the printing apparatus or in the host apparatus (information processing apparatus), providing print data. If the selection function is provided in the printing apparatus, the printing apparatus may comprise an input section to which information on the attributes of the image to be printed is input. Further, the information on the attributes of the image may be detected on the print data on that image. The relevant detection function may be provided in the printing apparatus or in the host apparatus.

Furthermore, it is possible to set, as required, the relationship between the attributes of the image to be printed and the dispersive or sequential driving control, selected in accordance with the attributes. The point is that the driving control suitable for the type of the image to be printed can be selected to allow the image to be excellently printed. The image printed under the dispersive driving control is not limited to one containing at least one of two types of straight lines, a bar code and a ruled line. The image has only to give priority to linearity.

Further, depending on whether the dispersive driving control or the sequential driving control is selected, the function of changing the conveyance speed of a print medium may be provided in the printing apparatus or in the host apparatus. The degree of a change in the conveyance speed of the print medium is not limited to the above embodiments. The conveyance speed may be changed to any degree.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-215153, filed Aug. 8, 2006, and 2007-181372 filed Jul. 10, 2007 which are hereby incorporated by reference herein in their entirety.

What is claimed is:

1. A printing apparatus that prints an image on a print medium by using a print head having a plurality of print elements arranged in a direction crossing a direction in which the print medium is conveyed, to drive a plurality of print element groups into which the plurality of print elements are divided, in a time divisional manner, the apparatus comprising:

dispersive driving means for driving the plurality of print element groups in a time divisional manner so as to sequentially drive the print element groups not located close to each other; and sequential driving means for driving the plurality of print element groups in a time divisional manner so as to sequentially drive the print element groups located close to each other, wherein the dispersive driving means or the sequential driving means is selected for functioning in accordance of attributes of the image to be printed.

2. The printing apparatus according to claim 1, wherein the plurality of print elements are divided into a plurality of blocks, each of the plurality of blocks includes a plurality of the print element groups, and the dispersive driving means and the sequential driving means drive the plurality of print element groups in each of the blocks in a time divisional manner.

3. The printing apparatus according to claim 1, further comprising selection means for selectively allowing one of the dispersive driving means and the sequential driving means to function.

4. The printing apparatus according to claim 3, further comprising an input section to which information on the attributes of the image is input.

5. The printing apparatus according to claim 3, further comprising detection means for detecting the attributes of the image on the basis of the print data on the image.

6. The printing apparatus according to claim 1, wherein the dispersive driving means is selected for functioning when the image contains a straight line.

7. The printing apparatus according to claim 6, wherein the image containing the straight line contains at least one of a bar code and a ruled line.

8. The printing apparatus according to claim 1, further comprising changing means for changing a speed at which the print medium is conveyed, depending on whether the dispersive driving means or the sequential driving means function.

9. The printing apparatus according to claim 1, wherein the print head is an ink jet print head comprising nozzles that can eject ink, as the print elements.

10. A printing system comprising the printing apparatus according to claim 1; and an information processing apparatus that supplies the print data on the image to the printing apparatus.

11. A method for printing an image on a print medium by using a print head having a plurality of print elements arranged in a direction crossing a direction in which the print medium is conveyed, to drive a plurality of print element groups into which the plurality of print elements are divided, in a time divisional manner, the method comprising:

a step of selecting dispersive driving control or sequential driving control in accordance with the image to be printed to drive the plurality of print element groups in a time divisional manner, and wherein the dispersive driving control drives the plurality of print element groups in a time divisional manner so as to sequentially drive the print element groups not located close to each other, and the sequential driving control drives the plurality of print element groups in a time divisional manner so as to sequentially drive the print element groups located close to each other.

* * * * *